United States Patent [19]

Allgood

[11] 4,008,703

[45] Feb. 22, 1977

[54] FIREPLACE HEATING SYSTEM

[76] Inventor: Tommy L. Allgood, 2035 Arizona, Joplin, Mo. 64801

[22] Filed: Apr. 17, 1975

[21] Appl. No.: 569,005

[52] U.S. Cl. ..... 126/121; 126/163 R; 165/179; 237/51

[51] Int. Cl.[2] ..... F24H 3/08

[58] Field of Search ..... 237/51; 126/121, 122, 126/163 R, 164; 165/179, 174; 122/275–283

[56] References Cited

UNITED STATES PATENTS

| | | | |
|---|---|---|---|
| 1,640,771 | 8/1927 | Hannum | 126/121 |
| 2,077,599 | 4/1937 | Wales | 237/51 |
| 2,828,078 | 3/1958 | Snodgrass | 237/51 |
| 3,001,521 | 9/1961 | Reilly | 237/51 X |

FOREIGN PATENTS OR APPLICATIONS

| | | | |
|---|---|---|---|
| 944,850 | 3/1947 | France | 165/179 |

*Primary Examiner*—William E. Wayner
*Assistant Examiner*—William E. Tapolcai, Jr.
*Attorney, Agent, or Firm*—Lowe, Kokjer, Kircher, Wharton & Bowman

[57] ABSTRACT

A plurality of interconnected pipes are installed in a fireplace to utilize the heat generated therein for the purpose of heating a room. The pipes are arranged in upper and lower sections that provides a pair of closed paths in which air is circulated by a fan. Cast iron slugs are spaced within the pipes in order to transfer heat to the circulating air and to increase the air turbulence. Outlet conduits receive heated air from the upper and lower sections and distribute it in the area that is to be heated.

8 Claims, 3 Drawing Figures

FIREPLACE HEATING SYSTEM

BACKGROUND AND SUMMARY OF THE INVENTION

This invention relates generally to heating apparatus and more particularly to a heating system which extracts heat from a fireplace and distributes heated air to a room.

The heat generated in a fireplace is typically not utilized in an effective manner for room heating purposes, mainly because much of the heat is discharged through the chimney of the fireplace. Even the heat that is transferred to the room tends to create an uncomfortably warm region in the immediate vicinity of the fireplace while having little heating effect on the more remote areas of the room. The large losses and uneven heat distribution result in the waste of a significant amount of potentially useful heat energy, and this is particularly undesirable in view of rapidly rising fuel costs and the recent emphasis on energy conservation.

It is therefore a primary object of the present invention to provide a heating system which efficiently utilizes the heat generated within a fireplace in order to heat a room. The heating system includes a plurality of interconnected pipes that are installed within the fireplace to accommodate a flow of air which is heated prior to being distributed to the room.

Another object of the invention is to provide a heating system of the character described which maximizes the heat transfer from the fire to the circulating air. This important result is achieved principally by the turbulent air flow which is caused by the novel pipe arrangement and also by the spaced metal slugs which restrict the flow within the pipes.

A further object of the invention is to provide a heating system of the character described wherein the circulating air continues to receive substantial amounts of heat even after the fire has died out. The heat retained by the solid slugs is transferred to the passing air for a considerable period of time after the fire has been extinguished, and the structural irons which support the pipes also continue to transfer heat to the pipes and ultimately to the circulating air.

Yet another object of the invention is to provide a heating system for a fireplace which is easily installed, economical to manufacture, and readily accessible for maintenance purposes.

Other and further objects of the invention, together with the features of novelty appurtenant thereto, will appear in the course of the following description.

DETAILED DESCRIPTION OF THE INVENTION

In the accompanying drawing, which forms a part of the specification and is to be read in conjunction therewith, and in which like reference numerals are employed to indicate like parts in the various views.

Figure 1:
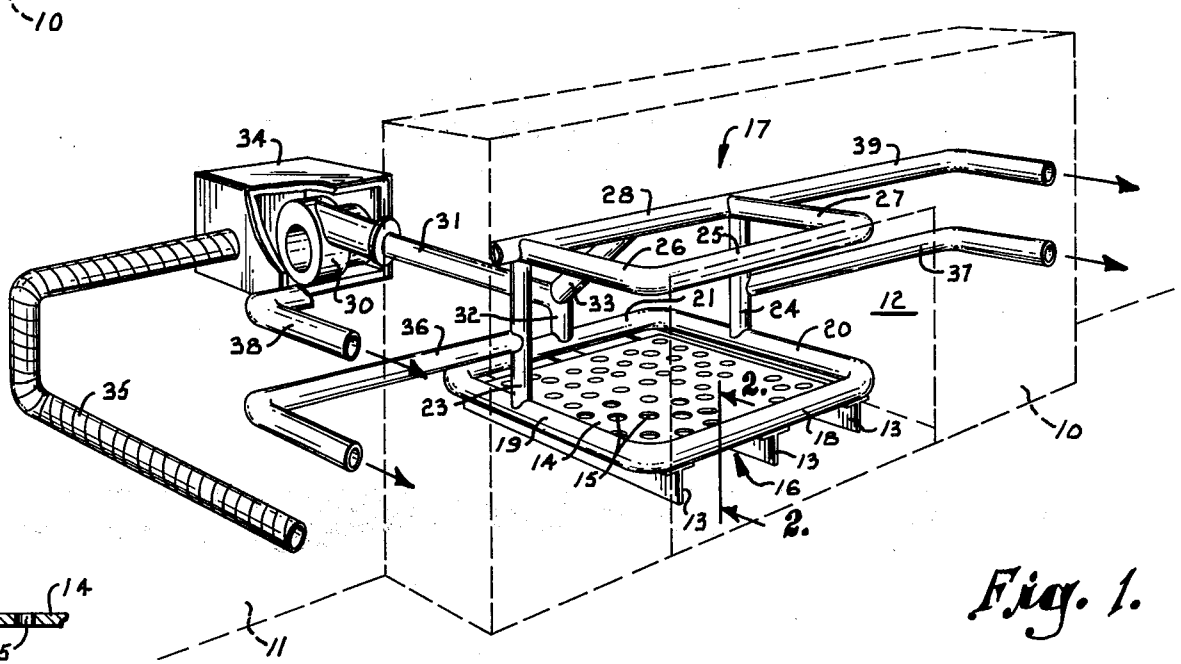
FIG. 1 is a perspective view illustrating a heating system embodying the invention installed within a fireplace, with portions of the fan housing and one outlet conduit broken away from clarity and the fireplace shown in broken lines.

Referring now to the drawing in detail and initially to FIG. 1, reference numeral 10 generally designates a fireplace which may be constructed of brick or any other suitable material. Fireplace 10 usually projects inwardly from a wall 11 and includes the usual rectangular chamber 12 which is recessed into the wall. A glass panel screen (not shown) preferably covers the front of chamber 12 when a fire is burning therein but the subject system will operate with the conventional metal screen. A chimney (also not shown) provides an outlet for smoke emitted from the fire.

Three T-shaped rails 13 are secured to the floor of chamber 12 and are parallel to one another. The flat upper flange of each rail 13 is disposed horizontally a short distance above the floor. It is preferred that rails 13 be constructed of iron or steel, although any material having suitable structural and heat conducting characteristics may be used. A rectangular grate 14 having a plurality of irregularly arranged openings 15 rests freely on top of rails 13. Grate 14 receives the logs which are burned in the fireplace, while openings 15 permits ashes to drop through the grate and onto the floor of chamber 12 where they may be swept away.

In accordance with the heating system of the present invention, a plurality of interconnected pipes are installed within chamber 12 and are arranged to form a lower section 16 and an upper section 17. The lower section comprises a front pipe 18, a pair of opposite side pipes 19 and 20, and a rear pipe 21 which are all connected together in a substantially rectangular configuration. Pipes 18 through 21 may be welded together in an integral construction with curved corners as shown in FIG. 1. Alternatively, the pipes in lower section 16 may be connected at their ends by conventional elbow fittings (not shown). In any event, the pipes are hollow in order to define a closed path for the circulation of air. The pipes comprising lower section 16 are supported directly on top of rails 13 in a position surrounding grate 14 in order to permit removal of the grate. Pipes 18 through 21 are preferably cast iron because of its good heat conducting properties, although it is contemplated that other wheels may be used.

Somewhat rearwardly of their centers, side pipes 19 and 20 connect to respective vertical pipes 23 and 24 which support the upper section 17 on their top ends. The upper section also comprises four hollow cast iron pipes that are arranged substantially rectangularly to define a closed path for accommoating a flow of air. A front pipe 25, a pair of opposite pipes 26 and 27, and a rear pipe 28 are connected together to form the upper section 17. The vertical pipes 23 and 24 connect to the opposite rear corners of upper section 17 and thereby support the upper section a spaced distance above the lower section and near the ceiling of chamber 12. As shown in FIG. 1, side pipes 26 and 27 of the upper section may be somewhat shorter than side pipes 19 and 20 of the lower section because many fireplaces have a curved back wall that reduces the depth of chamber 12 near its top.

A conventional electric motor driven fan 30 is operable to force air into the closed paths defined by the lower section 16 and the upper section 17. Fan 30 is located exteriorly of the fireplace and is preferably mounted to the back side of the wall 11. Fan 30 may have an automatic timing switch (not shown) which shuts the fan off after a preselected time interval or a thermostatic switch (also not shown) which energizes and deenergizes the fan according to the temperature conditions within the room that is being heated. The outlet of fan 30 connects to a conduit 31 which extend forwardly through wall 11 and into the back portion of chamber 12. At its forward end, conduit 31 divides into a lower branch 32 and an upper branch 33 which receive approximately equal amounts of the air that is discharged from the fan. Lower branch 32 extends downwardly from conduit 31 and connects at a right angle to a central portion of pipe 21. Upper branch 33 angles forwardly and upwardly from conduit 31 to a perpendicular connection with a central portion of the pipe 28.

Figure 3:
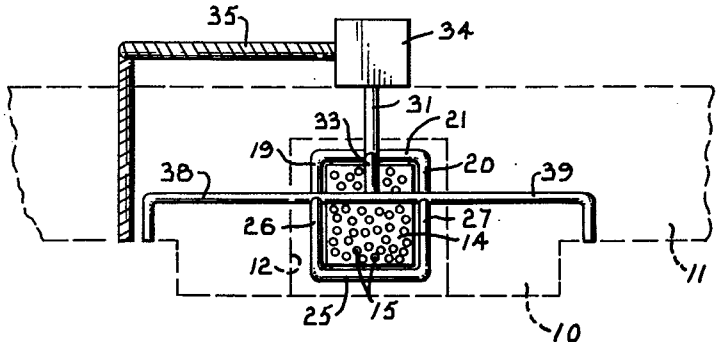
FIg. 3 is a top plane view of the heating system and fireplace shown in FIG. 1.

If wall 11 is an exterior wall of the house, it is undersirable from an efficiency standpoint for fan 30 to draw in cold air from outside for circulation through the pipes. Therefore, in this situation, an insulated fan housing 34 is mounted to the outside surface of wall 11 to enclose fan 30, as shown in FIGS. 1 and 3. Further, an insulated conduit 35 extends from the interior of the house to the fan housing 34 in order to provide the fan inlet with room temperature air. However, if the back side of wall 11 is located in another room of the house, fan housing 34 and insulated conduit 35 may be eliminated because fan 30 will then be able to draw in room temperature air directly from the second room.

Heated air is circulated from the lower section 16 into the bottom ends of the vertical pipes 23 and 24. The circulated air then enters the pair of horizontal outlet conduits 36 and 37 which connect to the appropriate midpoints of pipes 23 and 24, respectively. Each outlet conduit 36 and 37 leads to a conventional vent or the like (not shown) which distributes the air into the room that is to be heated. Although conduits 36 and 37 are illustrated as discharging into the room containing the fireplace, it is to be understood that any other area that requires heat may receive the warm air.

Upper section 17 is provided with two outlets that are located at the opposite rear corners thereof, and these outlets connect to respective horizontal outlet conduits 38 and 39. A vent (not shown) is provided on the discharge end of each conduit 38 and 39 to distribute warm air into the room. Again, it is pointed out that conduits 38 and 39 may led to a room other than that containing the fireplace.

Lower section 16 frequently provides enough warm air by itself to heat the room sufficiently and it is desirable under these conditions to circulate air through the lower section alone. Accordingly, branch 33 and the upper portions of vertical pipes 23 and 24 are preferably equipped with suitable valves (not shown) that can be closed to shut off upper section 17 and channel all of the air into the lower section.

Figure 2:
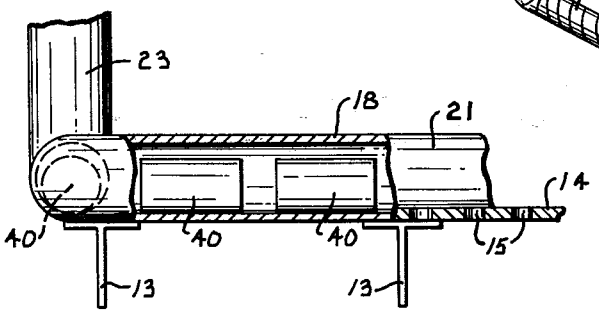
FIG. 2 is an enlarged elevational view, partially in cross-section, taken generally along line 2—2 of FIG. 1 in the direction of the arrows.

Referring now to FIG. 2, each of the pipes in lower section 16 and upper section 17 contains a plurality of solid cylindrical slugs 40 that are oriented coaxially with the pipes in which they are located. Slugs 40 are preferably cast iron in order to maximize the heat transfer characteristics of the system. It is to be understood that the slugs are spaced along the entire length of each pipe in the upper and lower section. However, the curved corners of sections 16 and 17 are free of slugs so that the air flow around these corners will not be unduly restricted. The cross-sectional area of each slug 40 is approximately half that of the pipe in which it is contained.

In use, fan 30 is switched on to begin circulating air within sections 16 and 17 after a fire has been built in chamber 12. The action of fan 30 forces air through conduit 31, and the air is split into two approximately equal streams when it encounters the separate branches 32 and 33. The stream in lower branch 32 is further split in half at its perpendicular junction with pipe 21, while the stream in upper branch 33 is likewise split as it meets pipe 28 at a right angle. Consequently, sections 16 and 17 each receive two streams of air which flow in opposite directions. Due to the arrangement of sections 16 and 17 in closed, endless paths, the oppositely flowing streams in each section are directed into a collision which results in considerable air turbulence. After having received heat from the fire through the various heat conducting pipes, the air flowing within lower section 16 is discharged in approximately equal amounts through outlet conduits 36 and 37. Similarly, the heated air in upper section 17 flows in equal quantities into the upper outlet conduits 38 and 39. The four outlet conduits 36, 37, 38 and 39 then distribute the warm air into the room that is to be heated through conventional vents (not shown). Of course, the invention is equally useful with fireplaces that burn logs, gas, and other fuels.

The aforementioned air turbulence which results from the closed configuration of sections 16 and 17 is highly desirable because it improves the efficiency of the heat transfer to the circulating air. The spaced slugs 40 further increase the turbulence because of the acceleration imparted to the air when it encounters the restricted area presented by the slugs. Additional turbulence and back pressures are created due to the abrupt area changes encountered by the air each time it meets or passes one of the slugs 40.

It is contemplated that fan 30 will remain running even after the fire has died out because the various pipes retain their heat well and continue to transfer it to the air. In addition, rails 13 remain hot and thus effectively conduct heat to the pipes since they are in direct contact therewith. The provision of solid metal slugs 40 within the pipes is particularly important in obtaining efficient heat transfer because the slugs are able to hold heat for a considerable length of time. Consequently, slugs 40 continue to heat the circulating air long after the fire has died out or been extinguished. Furthermore, due to their cylindrical shape, the slugs present a large surface area for contact with the air, while at the same time affecting the flow in the desirable manner previously related.

The rectangular configuration of lower section 16 and upper section 17 facilitates their construction and also effectively utilizes the available quantity of pipe. However, it is contemplated that either or both of the sections may be formed in a different configuration.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawing is to be interpreted as illustrative and not in a limiting sense.

Having thus described my invention, I claim:

1. A heating system for delivering heat from a fireplace to an area remote from the fireplace, the system comprising:

a plurality of conduits adapted to be installed in the fireplace and interconnected with one another to cooperate in defining an endless, closed loop path for accommodating a flow of air therethrough, said conduits being comprised of heat conducting material to enable heat generated in the fireplace to be transferred to air flowing within said path, said path having an inlet for receiving incoming air and a pair of outlets for discharging heated air;

a plurality of substantially solid slugs disposed in said path at spaced apart locations therein, said slugs being comprises of heat conducting material to transfer heat to the air passing thereby;

a fan located exteriorly of the fireplace, said fan having an inlet and an outlet;

means connecting said fan outlet with the inlet to said path, said fan thereby being operable to force air into said path and to circulate air therein; and air distributing means connected to the outlets of said path and extending to said remote area, said air distributing means receiving heated air from said path and distributing the heated air to said remote area.

2. A combination as set forth in claim 1 said slugs being of substantially cylindrical configuration and each slug having its longitudinal axis oriented generally parallel to the direction of air flow in said path, each slug presenting a substantially planar face oriented to face generally toward the air flowing theretoward.

3. A combination as set forth in claim 1, including means for supporting said conduits above the fireplace floor, said conduit supporting means comprising heat conducting material disposed in direct contact with said conduits to transfer heat thereto.

4. A combination as set forth in claim 1, wherein said outlets are substantially equidistant from the inlet to said path in opposite directions therefrom.

5. A combination as set forth in claim 1, including a thermally insulated fan housing enclosing said fan and a thermally inslulated conduit extending between a source of room temperature air and said fan inlet, whereby said fan is operable to deliver room temperture air to said path.

6. A combination as set forth in claim 1, including:

a second series of conduits interconnected with one another to cooperate in defining a second endless, closed loop path for accommodating a flow of air therethrough, the conduits in said second series being comprised of heat conducting material to enable heat to be transferred to air flowing within said second path, said second path having an inlet and at least one outlet communicating with said air distributing means;

means communicating said fan outlet with the inlet to said second path; and means for supporting said second series of conduits within said fireplace at a position elevated above the first mentioned plurality of interconnected conduits.

7. A heating system for delivering heat from a fireplace to an area remote from the fireplace, comprising:

a lower tier of heat conductive conduits adapted to be installed in the fireplace and interconnected to present an endless loop configuration providing a first closed path for accommodating a flow of air, said first path having an inlet and and outlet;

an upper tier of heat conductive conduits interconnected to present an endless loop configuration providing a second closed path for accommodating a flow of air, said second path having an inlet and and outlet;

means supporting said upper tier of conduits at an elevated position above said first tier;

fan means located exteriorly of the fireplace in communication with the inlets to said first and second paths, said fan means operable to force air into each path for circulation therein; and air distributing means extending from the outlets of said first and second paths to said remote area to deliver heated air thereto.

8. The invention of claim 7, wherein the means supporting said upper tier includes a pair of substantially vertical pipe members rigidly connected to extend between said lower and upper tiers at spaced locations, said first path having a pair of spaced outlets with the respective pipe members connected therewith, said distributing means connecting with each of said pipes members at a location intermediate the length thereof to deliver the heated air discharged from said first path.

* * * * *